US010343297B2

(12) United States Patent
Borges Fernandez et al.

(10) Patent No.: US 10,343,297 B2
(45) Date of Patent: Jul. 9, 2019

(54) DIE CUTTER BLANKET FOR COUNTER-DIE OF ROTARY DIE CUTTING MACHINE, AND METHOD FOR MANUFACTURING THE SAME

(71) Applicant: RODICUT INDUSTRY S.A.U., Pontevedra (ES)

(72) Inventors: David Borges Fernandez, Vigo (ES); Joaquin Cabaleiro Cabaleiro, Cesantes (ES); Marcelino Alvarez Alvarez, Vigo (ES)

(73) Assignee: RODICUT INDUSTRY S.A.U., Pontevedra (ES)

( * ) Notice: Subject to any disclaimer, the term of this patent is extended or adjusted under 35 U.S.C. 154(b) by 0 days.

(21) Appl. No.: 15/741,115

(22) PCT Filed: Jun. 30, 2015

(86) PCT No.: PCT/EP2015/064847
§ 371 (c)(1),
(2) Date: Dec. 29, 2017

(87) PCT Pub. No.: WO2017/000991
PCT Pub. Date: Jan. 5, 2017

(65) Prior Publication Data

US 2018/0207830 A1 Jul. 26, 2018

(51) Int. Cl.
*B26D 7/20* (2006.01)
*B26F 1/38* (2006.01)

(52) U.S. Cl.
CPC ..... *B26D 7/204* (2013.01); *B26D 7/20* (2013.01); *B26F 1/384* (2013.01); *B26D 2007/202* (2013.01)

(58) Field of Classification Search
CPC .... B26D 2007/202; B26D 7/20; B26D 7/204; B26F 1/384
See application file for complete search history.

(56) References Cited

U.S. PATENT DOCUMENTS

| | | | | |
|---|---|---|---|---|
| 3,657,852 | A * | 4/1972 | Worthington | E04F 15/02 52/392 |
| 3,882,750 | A | 5/1975 | Duckett et al. | |
| 4,240,192 | A | 12/1980 | Davis | |
| 5,076,128 | A | 12/1991 | O'Connor et al. | |
| 6,820,529 | B2 * | 11/2004 | Elia | B26D 7/20 83/347 |
| 2003/0041714 | A1 * | 3/2003 | Neal | B26D 7/20 83/347 |
| 2004/0244556 | A1 | 12/2004 | Neal | |

OTHER PUBLICATIONS

International Search Report and Written Opinion dated Apr. 25, 2016 for PCT/EP2015/064847.

* cited by examiner

*Primary Examiner* — Stephen Choi
(74) *Attorney, Agent, or Firm* — Lucas & Mercanti, LLP

(57) ABSTRACT

A die cutter blanket for a counter-die of a rotary die cutting machine has a cover that surrounds the counter-die forming a cylindrical sleeve around the counter-die. The cover is made from a first material having a first hardness value. The cover has a key adapted to fit into a slot of the counter-die in order to fix the cover around the counter-die. The die cutter blanket also includes a bar made from a second material having a hardness value greater than the first hardness value, which is disposed entirely inside the key, axially along the length of the key. The bar is peripherally coated by the first material.

10 Claims, 5 Drawing Sheets

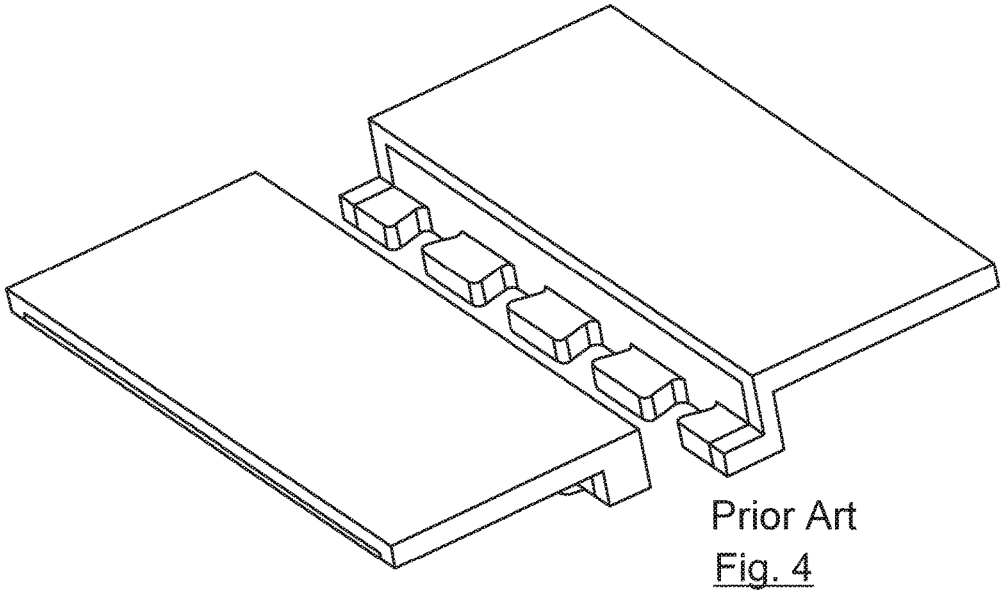
Prior Art
Fig. 4
Prior Art
Fig. 5a
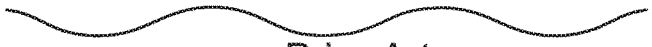
Prior Art
Fig. 5b
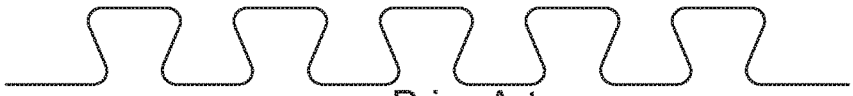
Prior Art
Fig. 5c

DIE CUTTER BLANKET FOR COUNTER-DIE OF ROTARY DIE CUTTING MACHINE, AND METHOD FOR MANUFACTURING THE SAME

CROSS REFERENCE TO RELATED APPLICATION

This Application is a 371 of PCT/EP2015/064847 filed on Jun. 30, 2015, which is incorporated herein by reference.

FIELD OF THE INVENTION

The present invention is encompassed within the technical field of rotary die cutting machines, specifically to the counter-die, or the cylinder which acts a base to let the blades of the die cutter cut the flat sheet material without being deteriorated.

The invention relates, in particular, to a die cutter blanket for counter-die of rotary die cutting machine, with a cover forming a cylindrical sleeve around the counter-die, the cover having a key insertable into a slot of the counter-die for the fixing thereof around the counter-die, and an inner bar inserted inside the key in order to obtain a better cardboard processing performance in this area similar as it is in the rest of the counter-die.

BACKGROUND OF THE INVENTION

As it is known, rotary die cutting machines for cutting flat cardboard sheets and similar materials, have mainly two cylinders made of steel, where the cardboard sheet goes between them. One of the cylinders incorporates the die cutter, and it acts as the cutter, while the second cylinder acts as a base to let the blades of the cutter cut the cardboard sheet without being deteriorated. The dies on the die cutting cylinder pass through the work piece in different orientations to form products from flat sheet material such as corrugated sheets.

The second cylinder, which acts as a base, is provided with anvil cover, or a blanket of a relatively soft material, which is typically made of polyurethane, to let the blades cut the cardboard without deteriorating them.

More specifically anvil covers or blankets are thick bands designed to surround the cylinder, that is, to form a kind of cylindrical sleeve, which is sometimes fixed to the cylinder by dimensional interference between a key of the polyurethane anvil cover and the slot of the cylinder, by screwing or by other different means.

The critical point, and the place where the problems arise, is the key of the cover, due to the higher thickness of polyurethane in that zone regarding the rest of the cover. Due to this, the area of the key provides a "soft spot" that suffers a deformation during the die-cutting of the cardboard that is greater than the deformation suffered by the rest of the cover, which is directly supported by the steel cylinder. This fact is known as "spring effect", and due to this great deformation of this "soft spot" a higher working pressure will be required, and the cardboard sheet could be deformed in the area of the key. FIG. 1 shows a section view of a blanket known in the prior art which schematically shows the "spring effect" on the "soft spot".

Additionally, and regarding the joint of the ends of the bands or blankets wrapping the counter-dies forming a cylindrical sleeve, there are several different conventional systems used nowadays:

1. Straight joint: the joint of the band or blanket is straight, along the axial direction of the cylindrical sleeve, so it tends to open. This causes a bad cardboard processing when a blade affects this straight joint, producing a bad cutting, scoring, and other defects.

2. Wave joint: the joint of the band or blanket have sinuous curve geometry whereby the possibility of a blade incision in an area of opening is reduced. However, the absence of interference or friction as a dovetail, will present similar problems related to the opening as the straight joint option.

3. Jig-Saw joint: by means of the engagement of fingers, this type of joint reduces the separation or opening on the joint. However, it presents difficult both the assembly and disassembly which means higher production costs due to increased downtime of the machine that are necessary for replacement. Regarding the assembly, the jig-saw joint intrinsically causes the deformation of the section of the fingers, so it will be necessary to overcome major interference by engaging the fingers. With regard to the disassembly, the large angles which tend to have the dovetail of a jig-saw joint difficult to remove the cover due to the required deformation for let the fingers slide over them.

Cutting the covers to configure the closure zone has associated problems in the joint. It is caused by the deformation of the key are due to the accumulation of the material. These deformation problems do not appear when joint geometries are "open", as disclosed in FIGS. 5*a* and 5*b* that is, with straight cuts, wave type, etc. (although these open geometries may have more problems around the joint area). However in case of "closed" geometries as dovetails, as disclosed in FIG. 5*c*, the large quantity of low hardness material at the key area causes that during the cutting exercise for the manufacture of the cover, the final geometry of the fingers do not correspond with those of the cutting blade as it forms pronounced curvatures in the section, as shown in FIG. 2.

This problem caused by the cutting in the key, to form the geometry of the finger, involves mounting complications because when attempting to introduce finger, in the hollows of which are previously fixed to the cylinder slot, large interference between these occurs. This is due to the deformation of the soft material (thicker in the area of the key) by expansion.

In order to try to solve these "spring effect" problems, there are some embodiments known in the prior art, as metal keys, or other key configurations as that shown in document U.S. Pat. No. 6,889,587B2. This document shows a configuration with plastic element with double hardness. In this case the key is divided into two substrates. The lower layer is part of an inner sleeve of greater hardness, vulcanized with the outer layer of lower hardness. However this layer does not reach the sides of the cover, in the axial direction of the shaft. On the other hand this layer occupies the full width of the slot. FIGS. 3 and 4 show an embodiment using a key made of hard material, which gives rise to openings in the joint, and poor fixing in the slot of the counter-die. Besides, since no deformation of the hard material is allowed, damage on the key and the slot of the counter-die occurs, and assembly/disassembly difficult increases.

Therefore the current joint systems for the blanket wrapping the counter-die undertake the processing of cardboard and difficult the assembly and/or disassembly thereof.

DESCRIPTION OF THE INVENTION

The present invention provides an advantage with respect to the current blankets for counter-die of rotary die cutting machines, providing a system with an improved cardboard processing performance on the key area and an easy assembly and disassembly.

This is achieved by means of a die cutter blanket for counter-die of rotary die cutting machine as disclosed in claim 1 of the present application.

This die cutter blanket comprises a cover made of a soft material to let the blades cut the cardboard without being deteriorated. Preferably, the hardness of the cover is about 85-95 ShA.

The cover wraps the counter-die in such a way that it forms a cylindrical sleeve around the counter-die. The cover comprises in turn a key insertable into a slot of the counter-die for the fixing thereof around said counter-die.

Additionally, the die cutter blanket has an inner bar inserted inside the key axially along its entire length, in such way that the dimensions of the section of the inner bar fit the geometry of the slot and this inner bar is peripherally coated by the cover, made by means of vulcanization.

The inner bar has a hardness which is higher than the hardness of the cover.

Particularly, the inner bar has a hardness close to the metal cylinder on which it lies, and unlike prior art covers with metal key does not need external elements to fix the cover to the cylinder. So, an improvement on accuracy processing cardboard is achieved. According a preferred embodiment of the invention, the hardness of the inner bar is typically up above 50 ShD.

Therefore, the inner bar inside the key makes the behaviour in the area of the key is similar to the rest of the counter-die, and so the need of increase pressure to compensate "spring effect" is reduced. Besides, unwanted marks during cardboard processing are also reduced.

So, a lower hardness material around the inner bar allows achieving the necessary tightness in the cylinder slot because of the deformation and so that the cover is securely attached to it. The inner bar is limited in the upper bound for the dummy projection of the perimeter of the cylinder on which it is mounted, so the thickness of the blanket over the key, in which the inner bar is housed, is the same as in the rest of the revolution.

This harder inner inner bar is previously placed in the slot to be vulcanized with the polyurethane that is poured into the mold to form the cover.

This inner bar solves additionally the problem caused by the cutting of the key during the manufacture of the blanket, since the presence of the rigid inner bar inside the key means that during the cutting, the material maintains its position, so that the dimensional stability is high even in the area of the key.

Due to this inner bar gives rise to dimensional stability and the lack of pronounced curvatures, there is less dimensional interference between fingers, which allow to initiate the assembly of the blanket manually and to end it easily only with a hammer. Therefore, the productivity is increased by means of shortening the cover assembly time.

Preferably, the cover comprises at each end a plurality of fingers engageable with the fingers of the other end, which provides a jig-saw joint of both ends of the die cutter blanket, forming the cylindrical sleeve around the counter-die.

This plurality of fingers solves the problems presented by the current prior art solutions in terms Of the quality of processed cardboard, and ease of assembly and disassembly of the cover.

The geometry of the fingers that will form the joint must ensure correct joining of the ends of the cover, minimizing the opening and simultaneously facilitating disassembly, reducing the collision between fingers.

BRIEF DESCRIPTION OF THE DRAWINGS

Next, in order to facilitate the comprehension of the invention, in an illustrative rather than limitative manner an embodiment of the invention with reference to a series of figures shall be made below.

FIG. 4 shows an overall schematic view of the ends of the blanket of FIG. 3.

FIGS. 5*a*, 5*b* and 5*c* show schematically different conventional joining systems known in the prior art for the joint of the ends of the blankets to form the cylindrical sleeve wrapping the counter-die.

Figure 1:
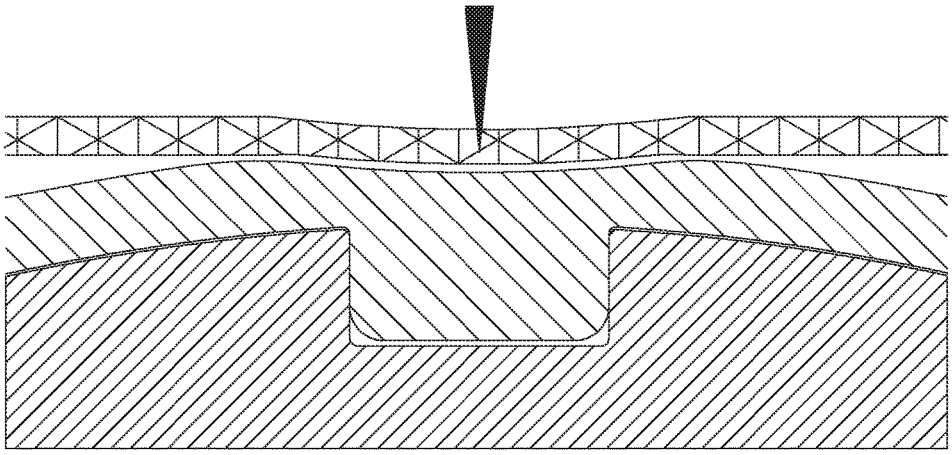
Prior Art Fig. 1
FIG. 1 shows a schematic section view of a blanket known in the prior art.
Figure 2:
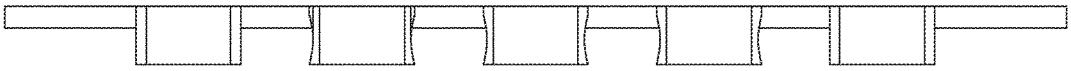
Prior Art Fig. 2
FIG. 2 is a schematic front view of one end of a blanket known in the prior art showing the fingers of the joining system.
Figure 3:
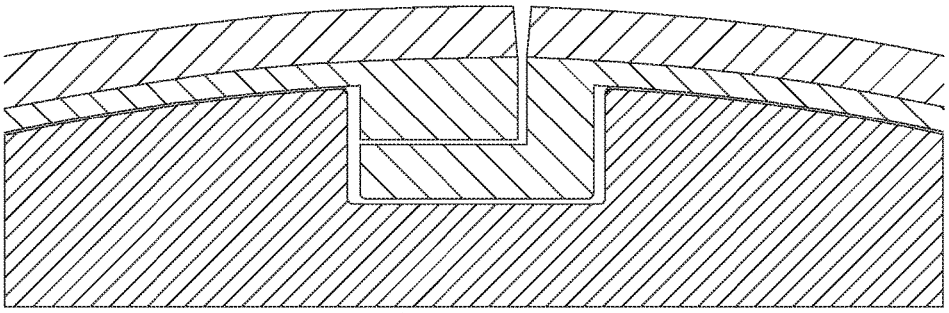
Prior Art Fig. 3
FIG. 3 shows a schematic section view of another blanket known in the prior art, with a key made of a material harder than the counter-die surface.
Figure 6:
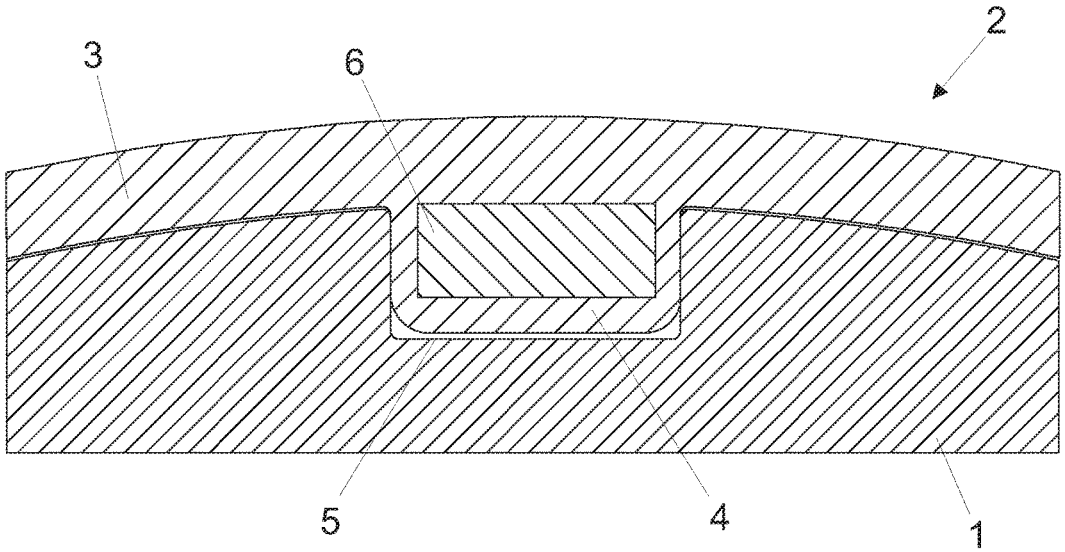
FIG. 6 shows a schematic section view of a blanket according the present invention.
Figure 7A:
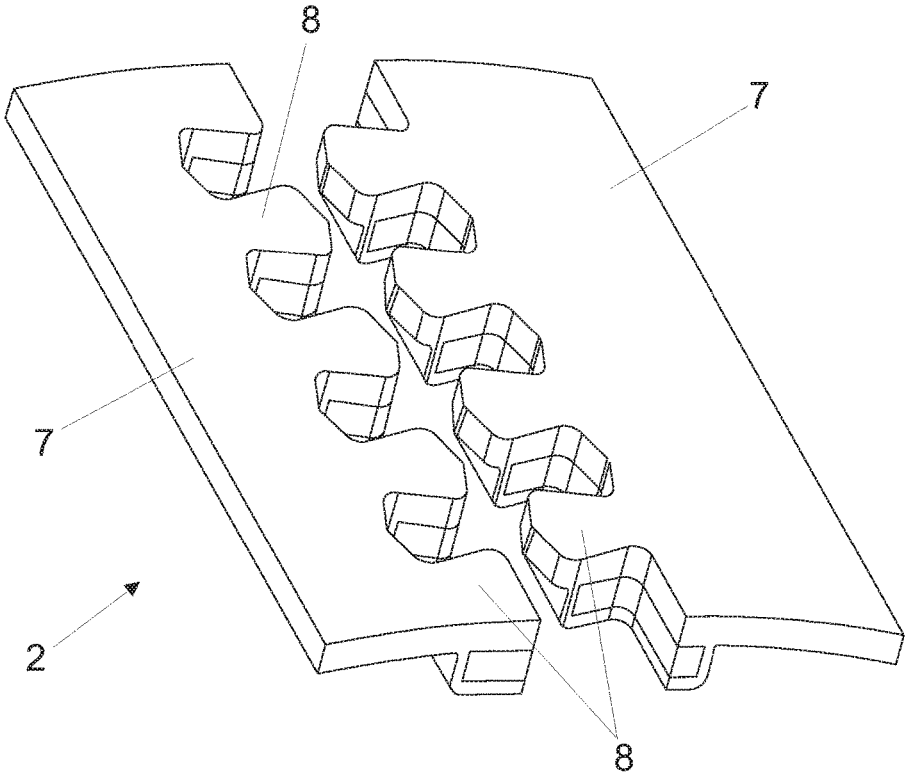
FIGS. 7*a* and 7*b* show an overall schematic view of the ends of the blanket of FIG. 6, FIG. 7*a* showing the ends of the blanket in an open finger position, and FIG. 7*b* showing the ends of the blanket in a closed finger position.
Figure 7B:
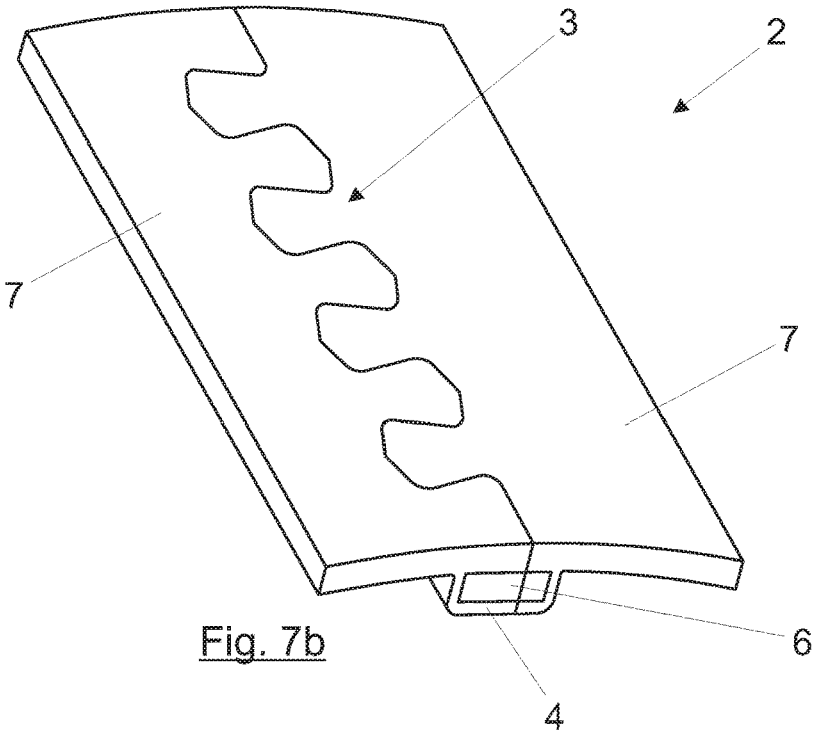
Figure 8:
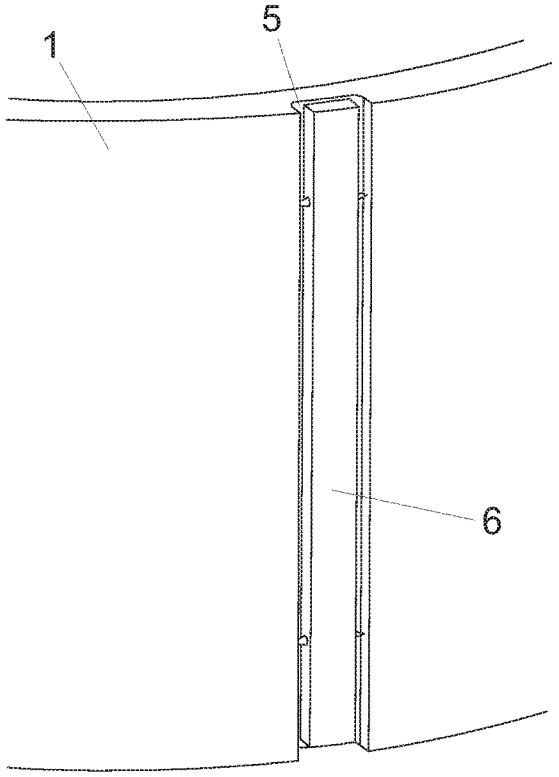
FIG. 8 shows a inner bar inserted in the slot of a mould, before vulcanized with soft material, according to the present invention.
Figure 9:
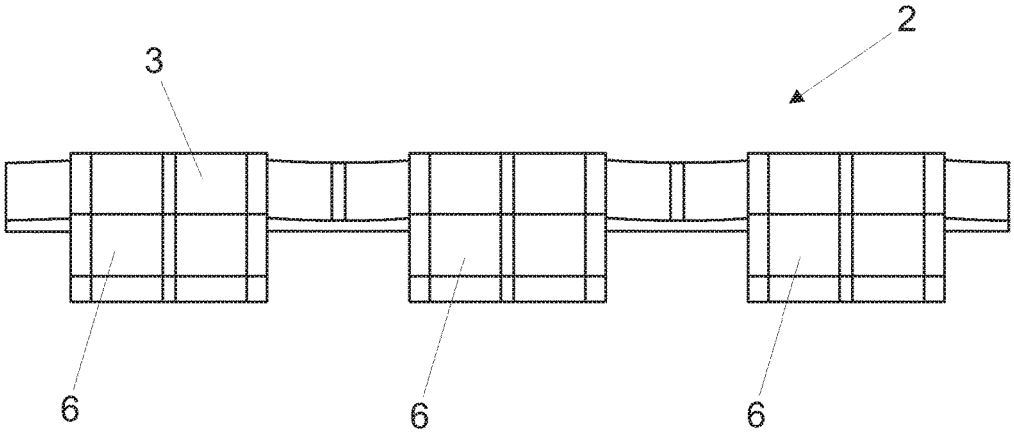
FIG. 9 shows a schematic front view of one end of a blanket with the typical position of the inner bar inside the fingers with straight section.

These figures refer to the following set of elements:

1. counter-die of the rotary die cutting machine
2. die cutter blanket
3. cover of the die cutter blanket
4. key of the cover of the die cutter blanket
5. slot of the counter-die
6. inner bar inserted inside the key of the die cutter blanket
7. ends of the die cutter blanket
8. fingers at both ends of the die cutter blanket
9. lateral sides of the fingers
10. front part of the fingers
11. straight two portions of the front part of the fingers
12. vertex of the front part of the fingers
b. angle between the two straight portions of the front part of the finger
a. angle of the lateral sides of the finger with the longitudinal axis of the cover

DETAILED DESCRIPTION OF THE INVENTION

The object of the present invention is a die cutter blanket for counter-die of rotary die cutting machine.

As shown in the figures, the die cutter blanket has a cover 3 that wraps the counter-die 1 forming a cylindrical sleeve around said counter-die 1. The cover is made of a soft material, preferably polyurethane.

The cover 3 comprises in turn a key 4 which is insertable into a slot 5 of the counter-die 1 for the fixing thereof around said counter-die 1.

The die cutter blanket comprises at least an inner bar 6 inserted inside the key 3 axially along its entire length, although according different embodiments of the invention, the inner bar 6 could be divided in several parts, or there could be more than one inner bar 6. As shown in FIGS. 6, 7*a*, 7*b* and 8, the dimensions of the section of the inner bar 6 fits the geometry of the slot 4, being the inner bar 6 peripherally coated by the cover 3.

The inner bar 6 has higher hardness than the cover 3, and particularly, the inner bar 6 has a hardness close to the counter die 1 on which it lies, and unlike prior art covers with metal key does not need external elements to fix the cover to the cylinder. So, an improvement on accuracy processing cardboard is achieved. According a preferred embodiment of the invention, the hardness of the inner bar 6 is up above 50 ShD, whereas that the hardness of the cover 3 is comprised between 85-95 ShA.

Preferably, for the most common key dimensions, a 0.5 mm thickness of coating material of lower hardness around the inner bar 6 is enough to ensure correct installation and ensure the functionality of the bar 6.

With accord to a particular embodiment of the invention, and regarding the joint of the ends 7 of the cover 3 to form the cylindrical sleeve around the counter-die 1, the cover 3 comprises at each end 7 thereof a plurality of fingers 8 engageable with the fingers 8 of the other end 7, which provides a jig-saw joint of both ends 7 of the die cutter blanket 2.

Figure 10:
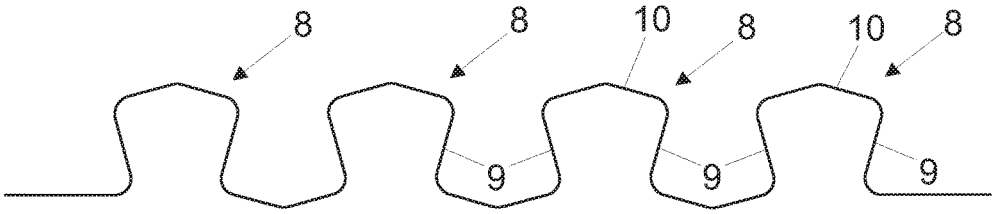
FIG. 10 shows schematically a joining system for the joint of the ends of the blankets to form the cylindrical sleeve wrapping the counter-die, according a preferred embodiment of the present invention.
Figure 11:
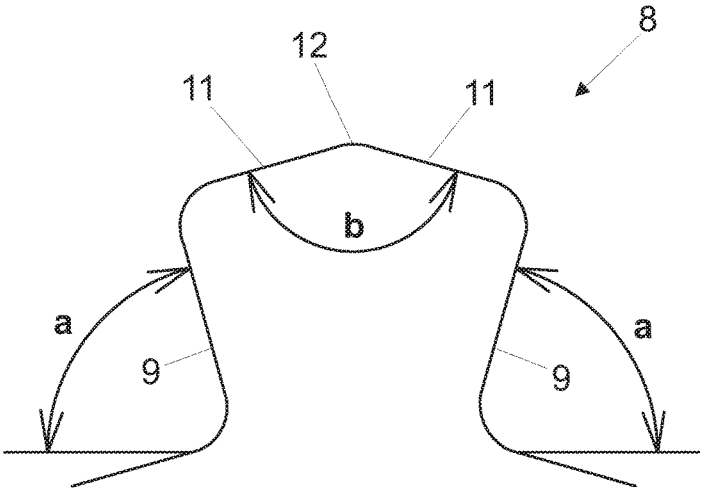
FIG. 11 shows in detail the fingers of the joining system of the embodiment of FIG. 10.

Particularly, and as it can be seen at FIGS. 10 and 11, the fingers 8 of the ends 7 of the cover have two lateral sides 9 and a front part 10, and according to a preferred embodiment, the front part 10 of the fingers 8 is arrowhead-shaped comprising two straight portions joined at a vertex 12, in such a way that they form an angle b comprised between 120° and 170°. These angles b are designed to avoid cutting, scoring or void cutting of axial direction blades, as usual in the cardboard processing. Values too big would reduce the desired effect, and values too small would greatly increase the finger 8 length and worsen the quality of the joint, since the fingers would not follow the curvature of the counter-die 1 (the longer the finger, the worse quality).

Preferably, the lateral sides 9 form an angle a comprised between 70° and 85° with the longitudinal axis of the cover 3, in order to adapt the geometry of the fingers 8 to the height thereof, which is defined in terms of width of the cylinder slot. This will ensure that collisions between fingers 8 are minimized, making easier the die cutter blanket 2 assembly and disassembly operations. Therefore, productivity will be increased by means of shortening cover assembly and disassembly time.

Once the invention has been clearly described, it is hereby noted that the particular embodiments described above can be the subject of detail modifications as long as they do not alter the fundamental principle and the essence of the invention.

The invention claimed is:

1. A die cutter blanket for a counter-die of a rotary die cutting machine, the die cutter blanket comprising:

a cover adapted to form a cylindrical sleeve around a counter-die of a rotary die cutting machine and to surround the counter-die, the cover comprising a key projecting from an inner surface of the cover, the key having a shape adapted to fit into a slot of the counter-die in order to fix the cover in place around the counter-die, the cover comprising a first material having a first hardness value; and at least one inner bar comprising a second material having a second hardness value greater than the first hardness value, wherein all of the second material is disposed inside the key in an axial direction along a length of the key, the at least one inner bar being peripherally coated by the first material of the cover.

2. The die cutter blanket according to claim 1, wherein the at least one inner bar has a hardness value greater than 50 ShD.

3. The die cutter blanket according to claim 1, wherein the cover is made of polyurethane.

4. The die cutter blanket of claim 1, further comprising:

a first key comprising the first material;

a first inner bar disposed within the first key, the first inner bar comprising the second material;

a second key comprising the first material; and a second inner bar disposed within the second key, the second inner bar comprising the second material.

5. The die cutter blanket according to claim 4, wherein:

the first key and the second key are aligned along a first longitudinal direction of the first and second keys; and the first inner bar and the second inner bar are aligned along a second longitudinal direction of the first and second inner bars.

6. The die cutter blanket according to claim 4, wherein the cover comprises a first end and a second end, a first plurality of first fingers disposed at the first end, and a second plurality of second fingers disposed at the second end, wherein the first plurality of first fingers are adapted to engage with the second plurality of second fingers to form a jig-saw joint in the die cutter blanket.

7. The die cutter blanket according to claim 6, wherein the first and second fingers divide the first and second keys and the first and second inner bars.

8. The die cutter blanket according to claim 6, wherein each first finger each second finger comprises a first lateral side, a second lateral side, and a front part.

9. The die cutter blanket according to claim 7, wherein the first and second lateral sides form an angle between 70° and 85° with a longitudinal axis of the cover.

10. The die cutter blanket according to claim 6, wherein each first finger and each second finger comprises a front part having an arrowhead shape comprising a first straight portion and a second straight portion, the first and second straight portions being joined at a vertex and forming an angle between 120° and 170°.

* * * * *